US005645259A

United States Patent [19]

Chen

[11] Patent Number: 5,645,259

[45] Date of Patent: Jul. 8, 1997

[54] FOLDABLE LEG ASSEMBLY FOR A TABLE

[76] Inventor: Kao-San Chen, No. 282, Sec. 2, Shu-Lin St., Tainan City, Taiwan

[21] Appl. No.: 668,542

[22] Filed: Jun. 21, 1996

[51] Int. Cl.[6] ..... F16M 11/38

[52] U.S. Cl. ..... 248/436; 248/188.6; 108/118

[58] Field of Search ..... 248/166, 436, 248/188, 188.1, 188.6; 108/118, 123, 128, 157

[56] References Cited

U.S. PATENT DOCUMENTS

| | | | |
|---|---|---|---|
| 1,617,806 | 2/1927 | Hanson | 248/436 X |
| 1,795,911 | 3/1931 | Walker | 248/436 |
| 3,136,272 | 6/1964 | Sprigman | 248/436 X |
| 3,157,136 | 11/1964 | Moody | 108/157 X |
| 3,235,038 | 2/1966 | Nesslinger | 248/166 X |
| 3,765,630 | 10/1973 | Woolley | 248/166 X |
| 4,974,525 | 12/1990 | Sheffield | 108/157 X |

FOREIGN PATENT DOCUMENTS

| | | | |
|---|---|---|---|
| 174269 | 1/1922 | United Kingdom | 248/436 |

*Primary Examiner*—Lanna Mai

*Attorney, Agent, or Firm*—Ladas & Parry

[57] ABSTRACT

A foldable leg assembly includes an adjacent pair of upright rail retaining legs, an adjacent pair of upright rail positioning legs, four sliding blocks and two parallel support rails. Each of the rail retaining legs has a rail accommodation chamber for accommodating one of the support rails therein when the leg assembly is folded and stored. Each of the rail positioning legs is provided with a rail positioning seat for positioning an upper end of one of the support rails when the leg assembly is erected. The rails are retained on the rail retaining legs, in such a manner that each of the rails is pivotable between a horizontal position, where the rail is positioned on one of the rail retaining legs and one of the rail positioning legs, and an erected position, where the rail can fall into the chamber of the corresponding rail retaining leg. A table top bridges the rails for use.

6 Claims, 9 Drawing Sheets

FOLDABLE LEG ASSEMBLY FOR A TABLE

BACKGROUND OF THE INVENTION

1. Field of the Invention

The present invention relates to a foldable leg assembly adapted to permit a table top to be placed thereon, more particularly to a foldable leg assembly which is convenient to store and to erect.

2. Description of the Related Art

FIGS. 1 and 2 illustrate a conventional foldable leg assembly 1 which permits a table top 17 to be placed thereon. The conventional foldable leg assembly 1 includes four upright legs 11, each of which has a longitudinally extending accommodation chamber 111 therein. Each of the four upright legs 11 has a top end provided with an upper positioning seat 12 and a bottom end provided with a lower positioning seat 13. The lower positioning seats 13 close the bottom ends of the accommodation chambers 111. Each of the upper positioning seats 12 has a top face formed with a substantially straight groove 121 and provided with an upwardly protruding pin 122. The foldable leg assembly 1 further includes a pair of support rails 14, each of which is disposed on the upper positioning seats 12 of an adjacent pair of the upright legs 11. Each of the support rails 14 has two end portions, each of which is formed with a hole 141. The straight grooves 121 of an adjacent pair of the upper positioning seats 12 of the upright legs 11 are adapted to receive one of the support rails 14. The holes 141 in the support rails 14 are adapted for insertion of the upwardly protruding pins 122 of the upper positioning seats 12 therein. The outer diameter of the support rails 14 is smaller than the diameter of the accommodation chambers 111. Each of the upright legs 11 is provided with a sliding block 15 which is sleeved slidably on one of the legs 11. The foldable leg assembly 1 further includes eight links 16, each of which interconnects and is pivoted to one of the sliding blocks 15 and one of the upper positioning seats 12 in such a manner that two links 16 which are disposed between an adjacent pair of upright legs 11 are crossly pivoted to each other. A flexible table top 17, which is made of a plurality of movably interconnected wooden strips 171 parallel to each other, can be placed over the two support rails 14.

To use the conventional foldable leg assembly 1, the sliding blocks 15 are moved upwardly to permit the four upright legs 11 to be moved away from each other to form an unfolded configuration, in which the distance between the upwardly protruding pins 122 of the upper positioning seats 12 of an adjacent pair of upright legs 11 is equal to the distance between the two holes 141 of the support rails 14. Each of the support rails 14 is positioned in the substantially straight grooves 121 of the upper positioning seats 12 of an adjacent pair of the upright legs 11. The upwardly protruding pins 122 of the upper positioning seats 12 are fittingly inserted into the holes 141 of the support rails 14 to prevent movement of the support rails 14 with respect to the positioning seats 12. The table top 17 is then placed on the support rails 14 in such a manner that the wooden strips 171 of the table top 17 are perpendicular to the support rails 14. To fold the leg assembly 1, the table top 17 and the support rails 14 are removed to permit the upright legs 11 to move toward each other by moving the sliding blocks 15 downwardly on the legs 11. Then, two of the lower positioning seats 13 are removed so that the support rails 14 can be inserted into the accommodation chambers 111. The two lower positioning seats 13 are sleeved back onto the bottom ends of the two legs 11.

The conventional foldable leg assembly 1 is convenient to erect and occupies small space after being folded. However, the conventional leg assembly 1 still has the following defects and should be improved. To unfold the leg assembly 1, two lower positioning seats 13 should be removed and the support rails 14 should be taken out and positioned on the upper positioning seats 12. Moreover, the sliding blocks 15 must be moved to predetermined positions on the legs 11, in which the width of the leg assembly 1 is equal to the distance between the two holes 141 of each of the support rails 14. Since the space occupied by the leg assembly 1 is not adjustable, the leg assembly 1 is not suitable when there is no sufficient ground surface to place the leg assembly thereon. The use range of the leg assembly 1 is limited. Furthermore, the lower positioning seats 13 removed from the leg assembly 1 during erecting and folding procedure of the leg assembly 1 is easily loosened and lost.

SUMMARY OF THE INVENTION

Therefore, the main object of this invention is to provide a foldable leg assembly for a table top to be placed thereon- The foldable leg assembly of this invention is more convenient to erect and to store and is suitable for use outdoors.

The foldable leg assembly of the present invention includes an adjacent pair of upright rail retaining legs, an adjacent pair of upright rail positioning legs, four sliding blocks, eight links, and two parallel support rails. Each of the pair of upright rail retaining legs has a rail accommodation chamber therein and an upper end provided with a fixed hollow rail retaining seat. Each of the hollow rail retaining seats has a top wall, a side wall connected securely to the top wall, and a retaining slot which extends from the top wall to the side wall and which is formed through the top and side walls- Each of the adjacent pair of the rail positioning legs has an upper end provided with a fixed rail positioning seat. Each of the rail positioning seats has a top surface formed with a generally straight positioning slot which has two open ends. The four sliding blocks are sleeved slidably on the rail retaining legs and the rail positioning legs respectively. Each of the eight links interconnects an adjacent pair of the rail retaining legs and the rail positioning legs. Each of the links is pivoted to one of the sliding blocks at an end thereof and to one of the rail retaining legs and the rail positioning legs at the other end thereof, in such a manner that two links which are interposed between each adjacent pair of the legs are pivoted to each other at middle portions thereof so as to form an X shape, thereby enabling the links to be folded on the legs by moving the blocks on the legs. Each of the two parallel support rails has a first enlarged end and a second enlarged end that are sized so as not to pass through said retaining slot of a corresponding one of the rail retaining seats, thus confining the first enlarged ends of the rails within the rail retaining seats respectively while keeping the second enlarged ends of the support rails outside of the rail retaining seats respectively. Each of the two parallel support rails extends into the straight slot of a corresponding one of the rail positioning seats so as to position the rails on the rail retaining legs and the rail positioning legs respectively for placement of the table top on the rails. The second enlarged ends of the rails are capable of being moved manually from the rail positioning seats and then turned upward to erect the rails so as to permit the rails to fall into the rail accommodation chambers of the rail retaining legs, in order to fold the links on the rail retaining legs and the rail positioning legs for storage and for transport. Accordingly, the leg assembly of the present invention can be erected and folded manually, thus achieving added convenience in erection and storage thereof.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 3:
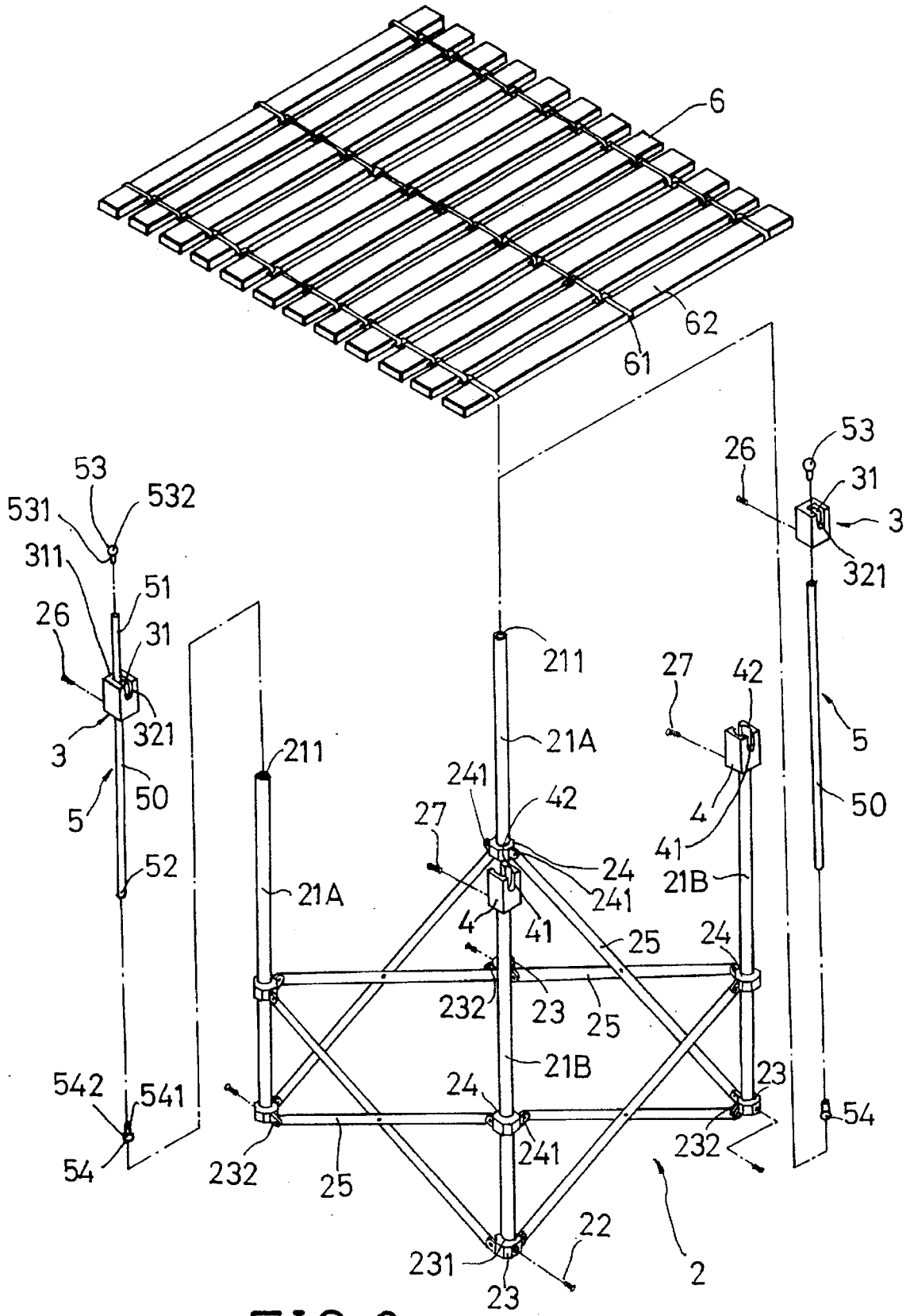
FIG. 3 is a partially exploded view of a foldable leg assembly of the present invention.
Figure 4A:
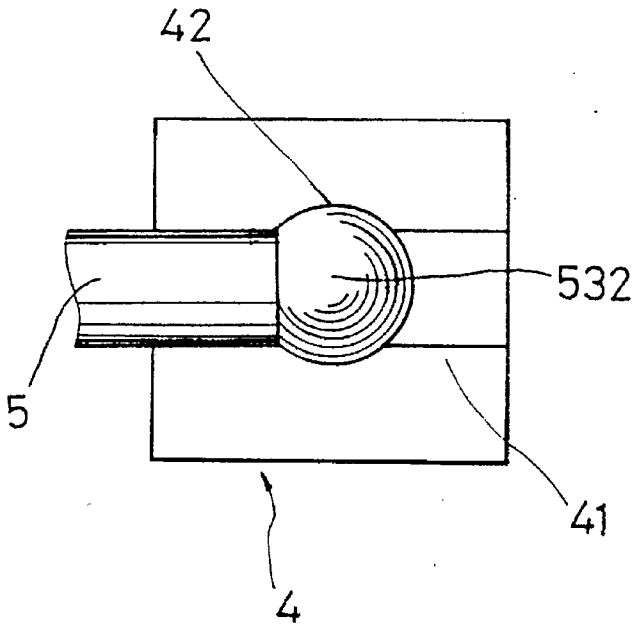
FIG. 4A is a top view of the rail positioning seat of the leg assembly shown in FIG. 3.
Figure 4:
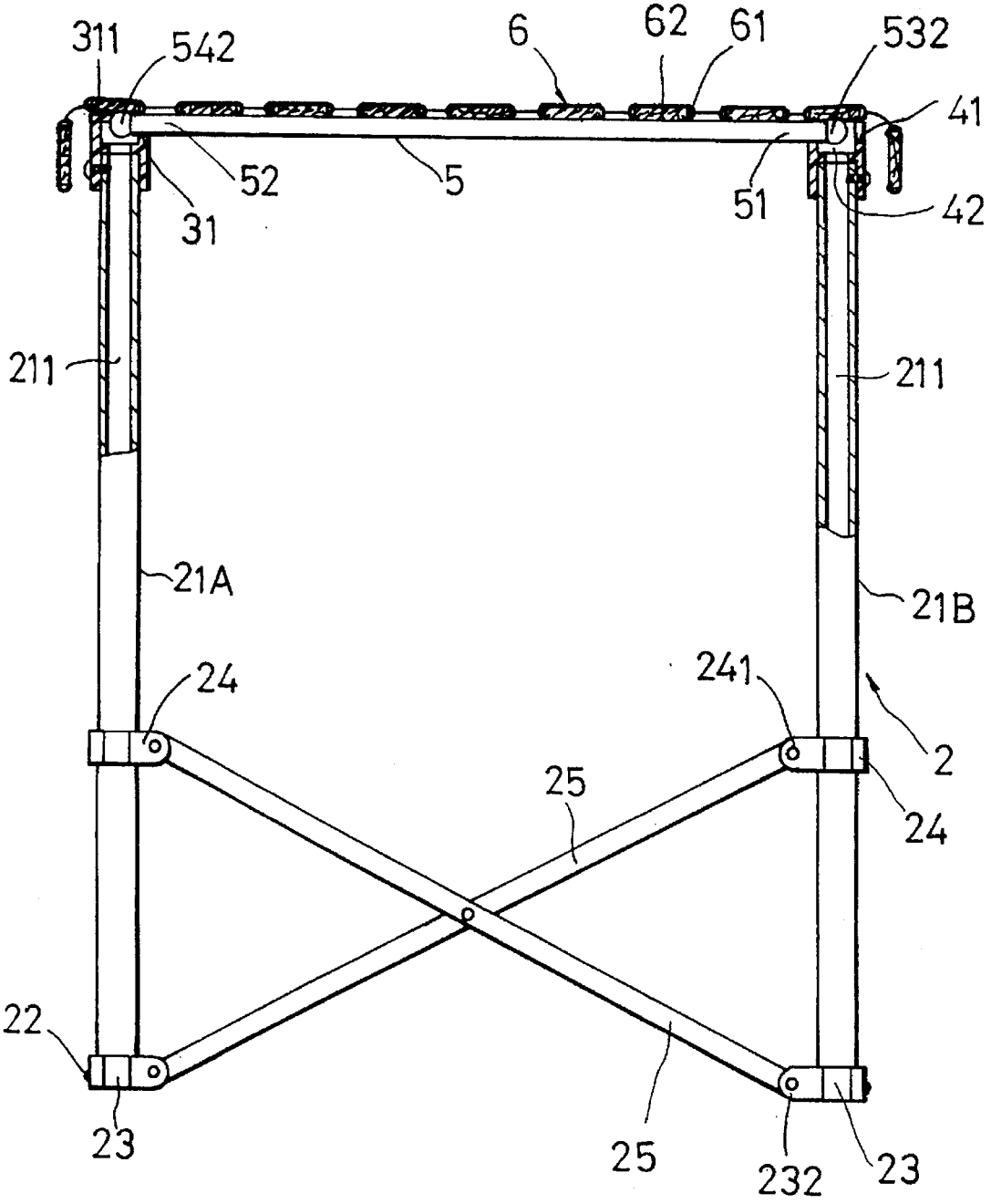
FIG. 4 is an elevational view of the leg assembly shown in FIG. 3 after being fully stretched.

Referring to FIGS. 3 and 4, a foldable leg assembly 2 of the present invention is shown to include four upright legs, which consists of an adjacent pair of rail retaining legs 21A and an adjacent pair of rail positioning legs 21B. Each of the rail retaining legs 21A is tubular in shape and has a substantially circular cross-section and an axially extending rail accommodation chamber 211 therein. The leg assembly 2 further includes four lower positioning seats 23, each of which is screwed to the bottom end of one of the rail retaining legs and the rail positioning legs 21A, 21B by a bolt 22. Each of the lower positioning seats 23 has a substantially rectangular periphery and an inner rounded hole 231 for retaining the bottom end of one of the legs 21A, 21B. Each of the lower positioning seats 23 has two side surfaces which face the adjacent legs 21A, 21B and which are formed with two fixed lower lugs 232, respectively. The leg assembly 2 includes four sliding blocks 24, each of which has a rectangular periphery and is sleeved slidably on one of the legs 21A, 21B. Each of the sliding blocks 24 is provided with a pair of upper lugs 241. The leg assembly 2 further includes eight links 25. Each of the links 25 is pivoted to an upper lug 241 of one of the sliding blocks 24 on one of the legs 21A, 21B at one end thereof, and to a lower lug 232 of the lower positioning seat 23 of an adjacent one of the legs 21A, 21B at the other end thereof and interconnects the upper and lower lugs 241, 232. The links 25 which are disposed between two adjacent legs 21A, 21B are pivoted to each other at middle portion thereof so as to form an X-shape. The leg assembly 2 includes a pair of rail retaining seats 3 fixed to the upper ends of the rail retaining legs 21A by bolts 26, a pair of rail positioning seats 4 fixed to the upper ends of the rail positioning legs 21B by bolts 27, and a pair of support rails 5 each of which passes through one of the rail retaining seats 3.

Figure 3A:
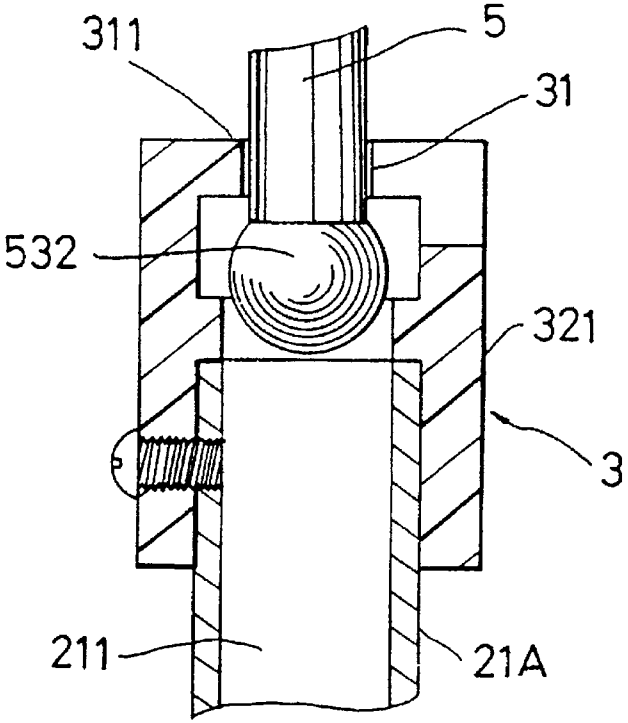
FIG. 3A is a schematic view illustrating how the rail retaining seat of the leg assembly of FIG. 3 is connected to a support rail and a rail retaining leg.

As shown in FIG. 3A, each of the pair of hollow rail retaining seats 3 fixed to the rail retaining legs 21A is rectangular in shape. Each of the hollow rail retaining seats 3 has a horizontal top wall 311, a vertical side wall 321 connected securely to the top wall 311, and a retaining slot 31 which extends from the top wall 311 to the side wall 321 and which is formed through the top and side walls 311, 321. The interior space of each of the hollow rail retaining seats 3 is communicated with the accommodation chamber 211 of a respective one of the rail retaining legs 21A.

As shown in FIGS. 3 and 4A, each of the rail positioning seats 4 is substantially rectangular in shape and is disposed at the same height as the rail retaining seats 3. Each of the rail positioning seats 4 has a top surface formed with a generally straight positioning slot 41 which has two open ends. The slot 41 in one of the rail positioning seats 4 is aligned with the slot 31 in a respective one of the rail retaining seats 3. The slot 41 of each of the rail positioning seats 4 has an enlarged middle portion 42.

Each of the pair of support rails 5 includes a tubular rail body 50 having two open ends 51, 52, and two end pieces 53, 54. The end pieces 53, 54 are preferably made of plastic. The end pieces 53, 54 have rounded outer heads 532, 542 and straight inner necks 531, 541 which are integrally formed with each other. The outer heads 532, 542 of the end pieces 53, 54 constitute the first and second enlarged ends of the support rails 5. The necks 531, 541 are press fitted within the open ends 51, 52 of the rail bodies 50. The rounded outer heads 532, 542 of the end pieces 53, 54 are too large in size to pass through the slots 31 of the rail retaining seat 3. Accordingly, the rounded outer heads 542 prevent the support rails 5 from being removed from the rail retaining seats 3. The rounded outer head 532 of each of the top end pieces 53 is capable of being received and positioned in the enlarged middle portion 42 of the slot 41 of a respective one of the rail positioning seats 4 and can be restricted by the top wall 311 of the corresponding rail retaining seat 3 to prevent the corresponding support rail 5 from falling entirely into the accommodation chamber 211 of the corresponding rail retaining leg 21A.

To assemble the leg assembly 2 of the present embodiment, the rail body 50 of each of the support rails 5 is passed through one of the hollow rail retaining seats 3 and the pair of end pieces 53, 54 are press fitted into the ends 51, 52 of the rail body 50 of the support rail 5. Then, each of the rail retaining seats 3 is screwed to the top end of one of the rail retaining legs 21A by a bolt 26 and each of the pair of rail positioning seats 4 are fixed to the top end of one of the rail positioning legs 21B by a bolt 27 in such a manner that each of the retaining slots 31 in the rail retaining seats 3 is aligned with the positioning slot 41 in a respective one of the rail positioning seats 4. A link 25 is then connected pivotally to a lower lug 232 of one of the lower positioning seats 23 at one end thereof and to an upper lug 241 of one of the sliding blocks 24 at the other end. The sliding block 24 is then sleeved slidably on an adjacent one of the legs 21A, 21B which is in turn coupled with a lower positioning seat 23.

When it is desired to place a table top 6 on the leg assembly 2 of the present embodiment, the sliding blocks 24 are moved downwardly to permit gradual increase of the distance between each adjacent pair of legs 21A and 21B. The support rails 5 are pulled upwardly from the rail accommodation chambers 211 such that the outer head 542 of the bottom end pieces 54 are stopped by the top walls 311 of the rail retaining seats 3. The support rails 5 are then turned toward the corresponding rail positioning seats 4 in such a manner that the outer heads 532 of the top end pieces 53 of the support rails 5 abut against the top end of the walls defining the enlarged middle portions 42 of the straight positioning slots 41 in the rail positioning seats 4. The outer heads 532 of the support rails 5 are then depressed so that they are received and clamped within the enlarged middle portions 42 of the slot 41 in the rail positioning seats 4. The two support rails 5 are parallel to each other. A table top 6 made of a plurality of parallel wooden strips 62 which are interconnected closely by means of retaining rings 61 can be placed over the two support rails 5 of the assembled leg assembly 2 to constitute a table.

Figure 5:
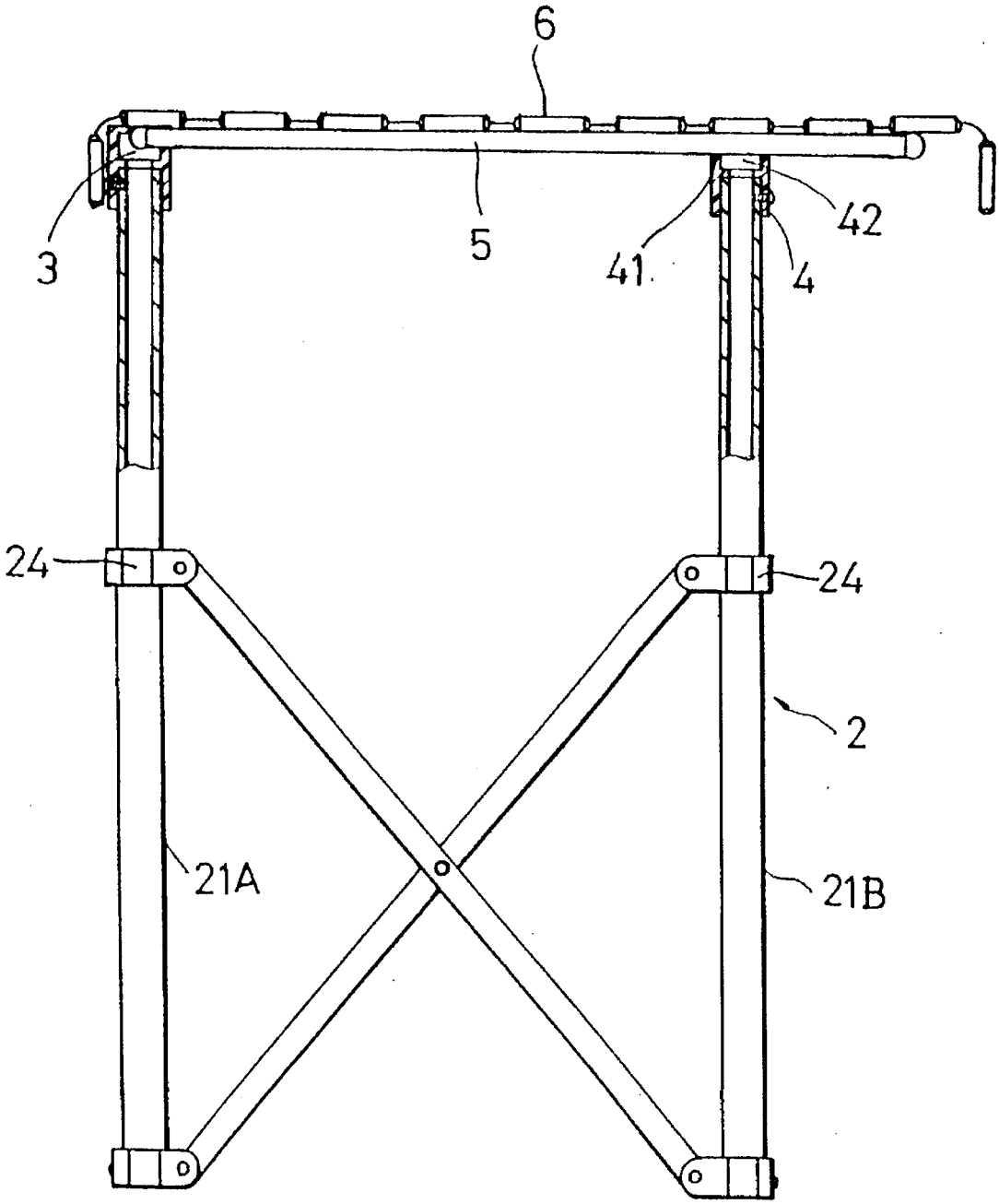
FIG. 5 illustrates the leg assembly shown in FIG. 3 after being partially stretched.
Figure 5A:
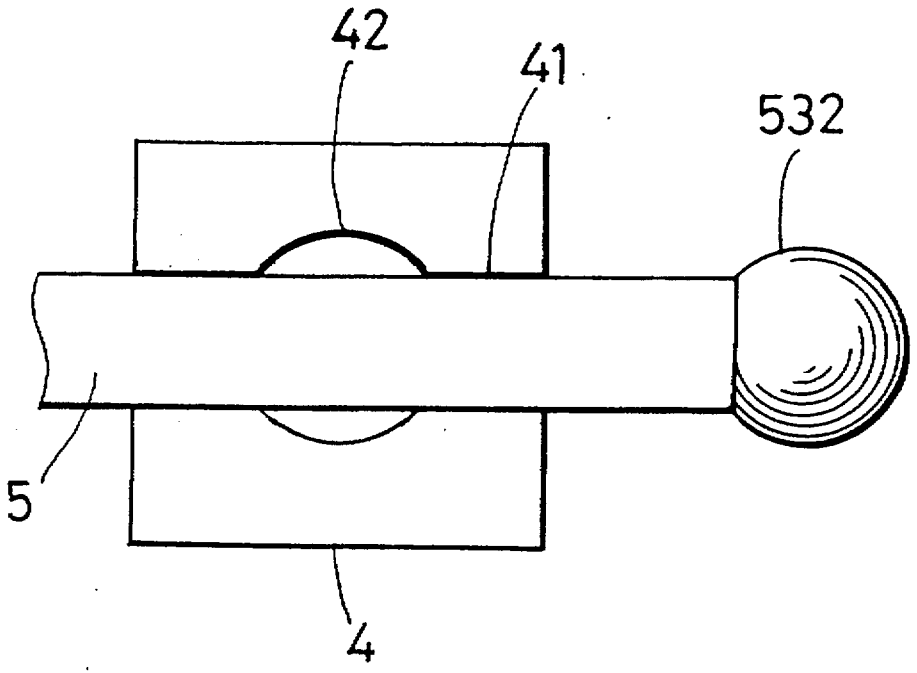
FIG. 5A is a top view of one of the rail positioning seats of the leg assembly shown in FIG. 5.

Referring to FIGS. 5, 5A, when there is no sufficient ground surface for erecting the leg assembly 2, the distance between the legs 21A and 21B can be reduced. The outer heads 532 of the support rails 5 can be removed upwardly to be disengaged from the enlarged middle portions 42 of the generally straight slots 41 of the rail positioning seats 4. Therefore, the rail positioning seats 4 can be moved toward the rail retaining seats 3 by moving the sliding blocks 24 on the rail retaining legs and rail positioning legs 21A and 21B to positions, in which the support rails 5 can be placed back into the generally straight slots 41 of the rail positioning seats 4, in such a manner that the outer heads 532 of the support rails 5 are located outside of the rail positioning seats 4. In this situation, the table top 6 can also be placed on the support rails 5.

Figure 6:
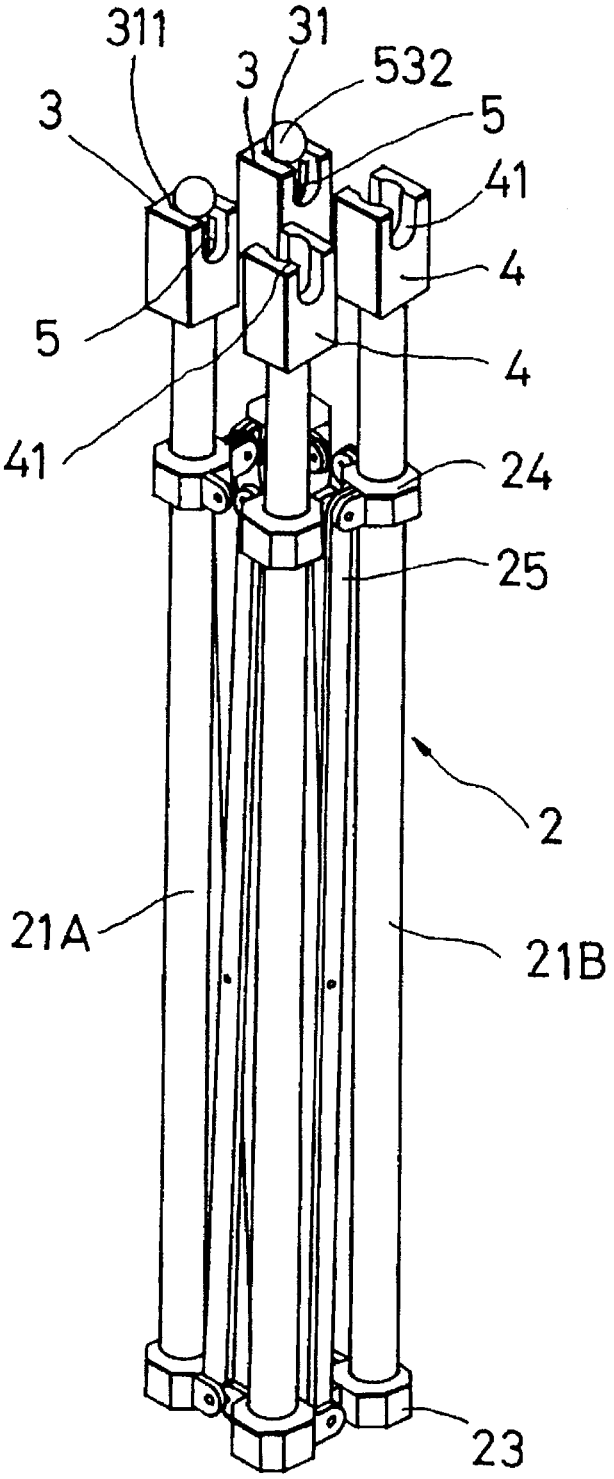
FIG. 6 is a perspective view of the leg assembly shown in FIG. 3 after being folded in order to be stored.

Referring to FIGS. 4 and 6, in order for the storage of the leg assembly 2 of the present embodiment, the table top 6 should be removed first. The outer head 532 of the support rails 5 are removed manually and turned upwardly from the slots 41 of the positioning seats 4 so that the rails 5 can be erected and fall into the rail accommodation chambers 211 of the rail retaining legs 21A. Since the diameter of the outer heads 532 is larger than the width of the slots 31 in the top walls 311 of the rail retaining seats 3, the outer head 532 can be kept outside of the top walls 311 of the rail retaining seats 3 to permit the Support rails 5 to be pull upwardly again for next use. The sliding blocks 24 are then moved upwardly to make the legs 21A and 21B close to each other so as to fold the leg assembly 2 for storage.

Figure 7:
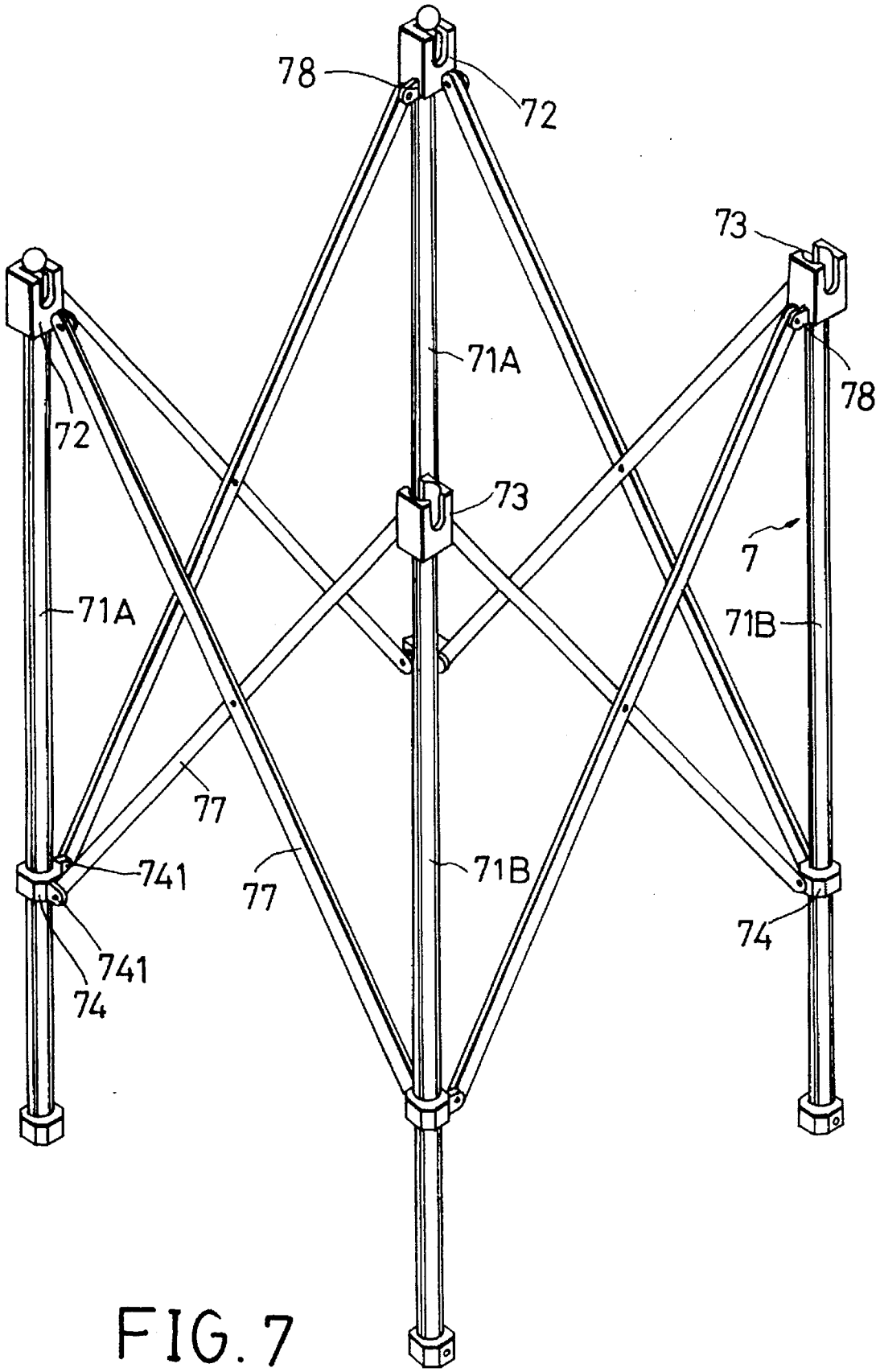
FIG. 7 is a perspective view of the leg assembly of another preferred embodiment of the present invention.

FIG. 7 illustrates another preferred embodiment of the leg assembly of the present invention. Each of the rail retaining seats 72 and the rail positioning seats 73 has side surfaces each of which is provided with a pair of upper lugs 78, each of that is pivoted to one end of one of the links 77. Each of the sliding blocks 74 has side surfaces each of which is provided with a pair of lower lugs 741, each of that is pivoted to The other end of one of the links 77. Therefore, a pair of links 77 is disposed between an adjacent pair of rail retaining legs and rail positioning legs 71A, 71B and pivoted to each other at the middle portions thereof. Each of the links 77 has a first end pivoted to the sliding block 74 on one of the legs 71A, 71B and a second end pivoted to one of the rail retaining seats 72 and the rail positioning seats 73 which is fixed to the top end of an adjacent leg 71A, 71B. The present embodiment can achieve the same object in erecting and folding of the leg assembly 7 as the previous embodiment.

Figure 1:
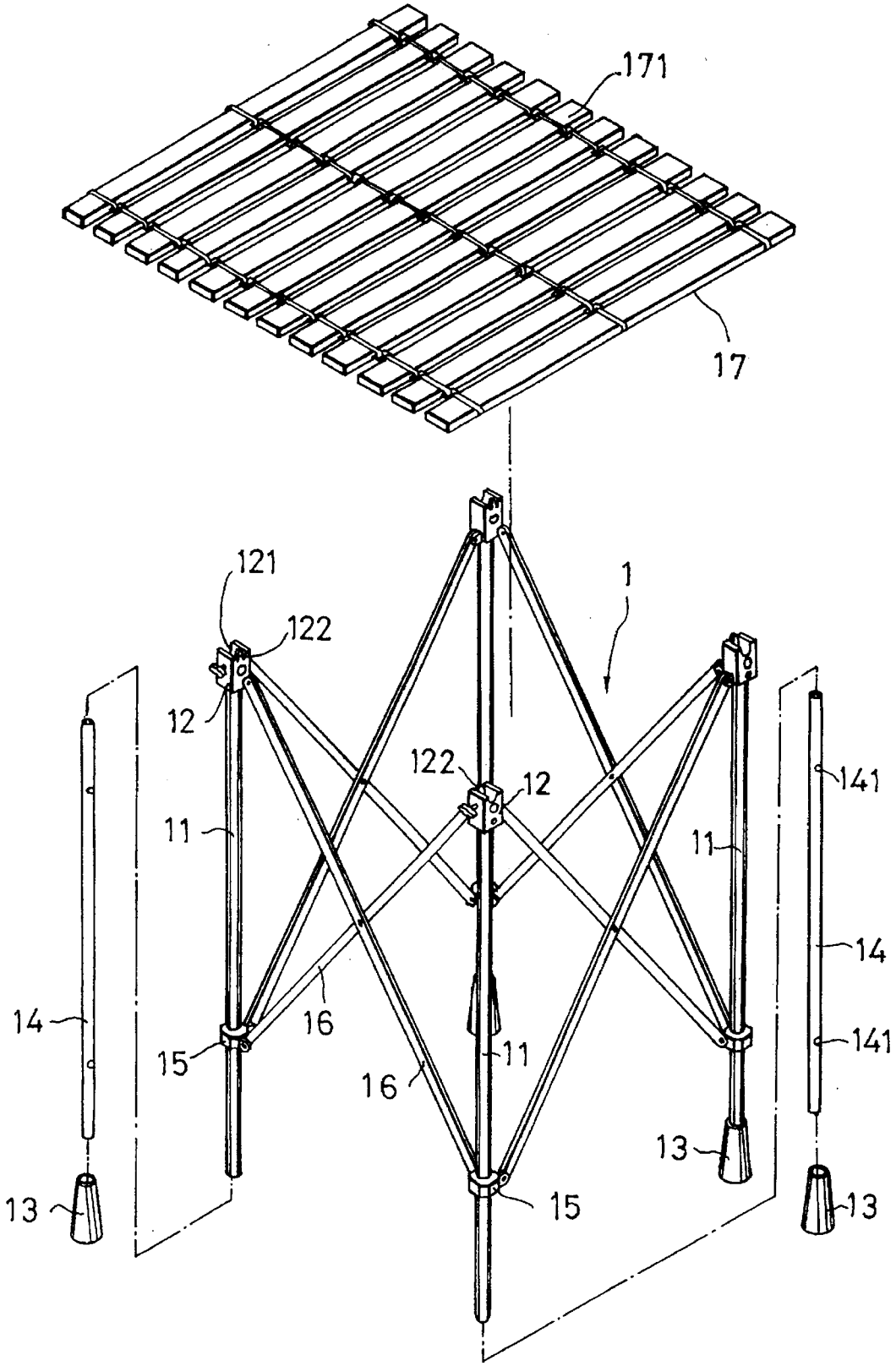
FIG. 1 PRIOR ART
FIG. 1 is a partially exploded view of a conventional leg assembly.
Figure 2:
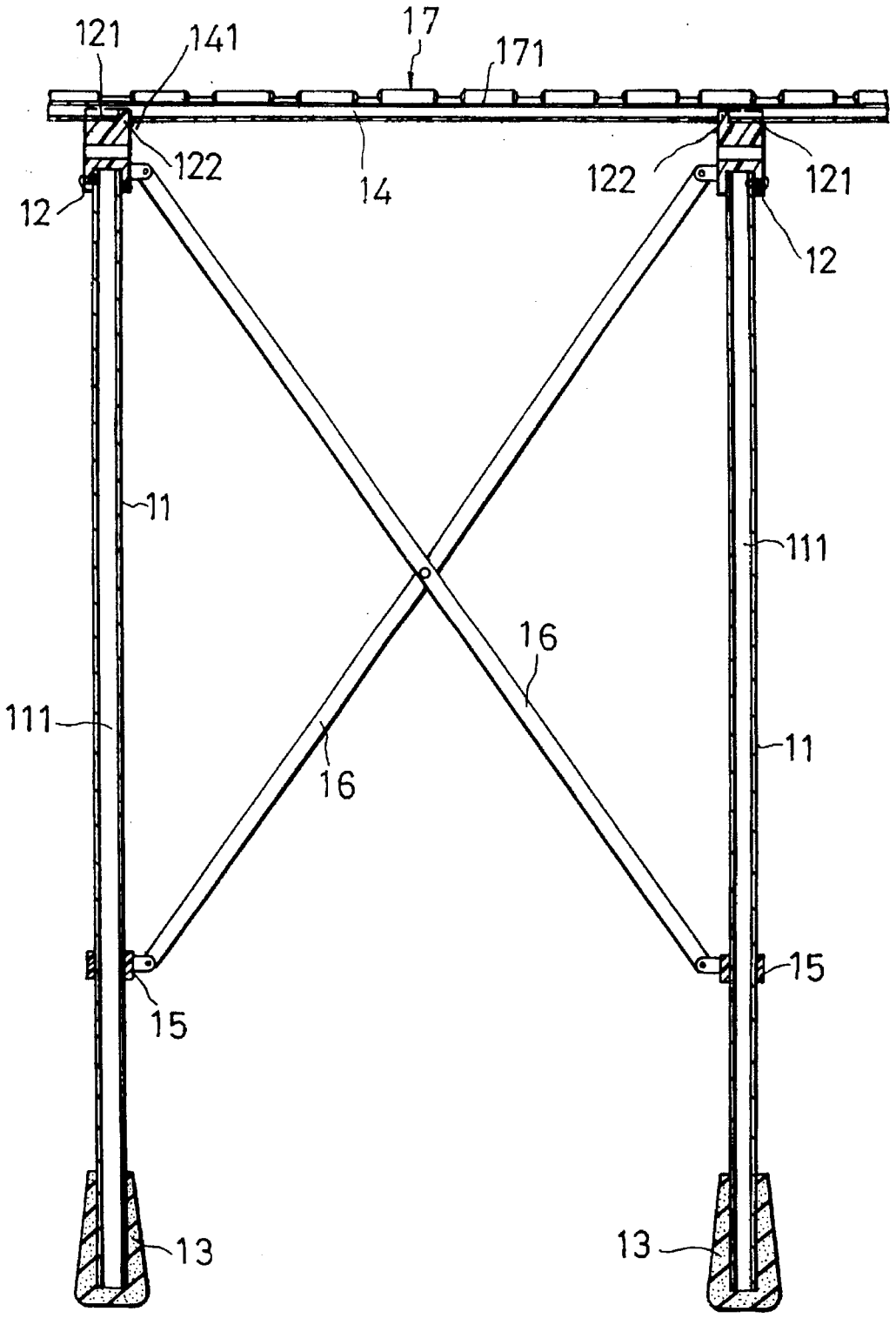
FIG. 2 PRIOR ART
FIG. 2 is a sectional view of the conventional leg assembly of FIG. 1.

The leg assembly of the present invention is easier to erect and more convenient to store, as compared to the prior art shown in FIGS. 1 and 2. The area occupied by the leg assembly of the present invention is adjustable. Moreover, the components don't need to be repeatedly removed from and fixed back to the legs. Therefore, the leg assembly of the present invention can provide added convenience in assemble and folding operation thereof.

With this invention thus explained, it is apparent that numerous modifications and variations can be made without departing from the scope and spirit of this invention. It is therefore intended that this invention be limited only as indicated in the appended claims.

I claim:

1. A foldable leg assembly adapted to permit a table top to be placed thereon, said assembly comprising:

an adjacent pair of upright rail retaining legs, each of which has a rail accommodation chamber therein and an upper end provided with a fixed hollow rail retaining seat, each of said rail retaining seats having a vertical side wall, a horizontal top wall connected securely to an upper end of said side wall, and a retaining slot which extends from said top wall to said side wall and which is formed through said top and side walls, each of said hollow rail retaining seats having an interior space communicated with the rail accommodation chamber in a respective one of the rail retaining legs;

an adjacent pair of upright rail positioning legs, each of which has an upper end provided with a fixed rail positioning seat, each of said rail positioning seats having a top surface formed with a generally straight positioning slot which has two open ends;

four sliding blocks respectively and slidably sleeved on the rail retaining legs and the rail positioning legs, respectively;

eight links each of which interconnects an adjacent pair of said rail retaining legs and said rail positioning legs and is pivoted to one of the sliding blocks at an end thereof and to one of said rail retaining legs and said rail positioning legs at the other end thereof, in such a manner that two of the links which are interposed between each adjacent pair of said rail retaining legs and said rail positioning legs are pivoted to each other at middle portions thereof so as to form an X-shape, thereby enabling said links to be folded on said legs by moving said blocks on said legs; and two parallel support rails, each of which has a first enlarged end and a second enlarged end that are sized so as not to pass through said retaining slot of a corresponding one of said rail retaining seats, thus confining said first enlarged ends of said rails within said rail retaining seats respectively while keeping said second enlarged ends of said rails outside of said rail retaining seats respectively, and each of which extends into said straight positioning slot in a corresponding one of said rail positioning seats so as to position said rails on said rail retaining legs and said rail positioning legs for placement of the table top on the rails, said second enlarged ends of said rails being capable of being removed manually from said rail positioning seats and then turned upward to erect said rails so as to permit said rails to fall into said rail accommodation chambers of said rail retaining legs, in order to fold said links on said rail retaining legs and said rail positioning legs for transportation and storage.

2. A foldable leg assembly as claimed in claim 1, wherein each of said generally straight positioning slots of said rail positioning seats has an enlarged middle portion which can receive clampingly a corresponding one of said second enlarged ends of said rails therein and which divides said straight slot into two straight sections that are located on two sides of said enlarged middle portion, each of said second enlarged ends of said rails having a diameter greater than width of said straight sections of said generally straight positioning slots, said second enlarged ends of said rails being capable of being disengaged from said enlarged middle portions of said generally straight positioning slots of said rail positioning seats so as to permit said rail positioning seats to be moved toward said rail retaining seats by moving said blocks on said legs to positions, in which said rails can be placed back into said generally straight positioning slots of said rail positioning seats, in such a manner that said second enlarged ends of said rails are located outside of said rail positioning seats.

3. A foldable leg assembly as claimed in claim 2, wherein said first and second enlarged ends of said rails are rounded, said enlarged middle portions of said generally straight positioning slots of said positioning seats having a generally circular cross-section.

4. A foldable leg assembly as claimed in claim 1, wherein each of said support rails includes tubular rail body having two open ends and two end pieces each of which consists of a rounded outer head and a straight inner neck that are integrally formed with each other, said necks being respectively press fitted within said ends of said rail bodies, said rounded outer heads constituting said first and second enlarged ends of said support rails.

5. A foldable leg assembly as claimed in claim 1, wherein each of said rail retaining legs and said rail positioning legs is provided with a lower positioning seat which is sleeved and screwed onto a lower end thereof and which has two sides surfaces each of that is formed with a fixed lug pivoted to a lower end of a corresponding one of said links, each of said sliding blocks having two sides surface each of that is formed with a fixed lug pivoted to an upper end of a corresponding one of said links.

6. A foldable leg assembly as claimed in claim 1, wherein each of said rail retaining seats and said rail positioning seats has two side surfaces each of that is formed with a fixed lug pivoted to an upper end of a corresponding one of said links, each of said sliding blocks having two side surfaces each of that is formed with a fixed lug pivoted to a lower end of a corresponding one of said links.

* * * * *